US007741768B2

(12) United States Patent
Wei et al.

(10) Patent No.: US 7,741,768 B2
(45) Date of Patent: Jun. 22, 2010

(54) FIELD EMISSION DEVICE WITH INCREASED CURRENT OF EMITTED ELECTRONS

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 725 days.

(21) Appl. No.: 11/139,707

(22) Filed: May 27, 2005

(65) Prior Publication Data

US 2005/0280009 A1 Dec. 22, 2005

(30) Foreign Application Priority Data

Jun. 7, 2004 (CN) ..... 2004 1 00276304

(51) Int. Cl.
*H01J 1/46* (2006.01)

(52) U.S. Cl. ..... 313/497; 313/296; 313/308

(58) Field of Classification Search ..... 313/495–497, 313/306, 309–310, 294–304, 351–355; 445/49–51; 438/20

See application file for complete search history.

(56) References Cited

U.S. PATENT DOCUMENTS

| | | | | |
|---|---|---|---|---|
| 5,209,687 | A * | 5/1993 | Konishi | 445/6 |
| 5,534,743 | A * | 7/1996 | Jones et al. | 313/309 |
| 5,606,215 | A | 2/1997 | Jaskie et al. | |
| 5,691,600 | A * | 11/1997 | Moyer et al. | 313/497 |
| 5,898,258 | A * | 4/1999 | Sakai et al. | 313/309 |
| 5,955,833 | A * | 9/1999 | Janning | 313/495 |
| 6,008,595 | A * | 12/1999 | Fink et al. | 315/308 |
| 6,036,565 | A | 3/2000 | Seko et al. | |
| 6,278,228 | B1 * | 8/2001 | Iwase et al. | 313/306 |
| 6,362,348 | B1 * | 3/2002 | Takahashi et al. | 549/315 |
| 6,373,174 | B1 * | 4/2002 | Talin et al. | 313/309 |
| 6,380,671 | B1 | 4/2002 | Lee | |
| 6,515,415 | B1 | 2/2003 | Han et al. | |
| 6,621,210 | B2 * | 9/2003 | Kato et al. | 313/496 |
| 2002/0017857 | A1 * | 2/2002 | Hashimoto et al. | 313/496 |
| 2002/0175607 | A1 * | 11/2002 | Hofmann et al. | 313/309 |
| 2003/0001490 | A1 * | 1/2003 | Yamamoto et al. | 313/495 |
| 2003/0141495 | A1 * | 7/2003 | Lee et al. | 257/10 |
| 2004/0104656 | A1 | 6/2004 | Wilson | |
| 2004/0248419 | A1 * | 12/2004 | Ono | 438/694 |

FOREIGN PATENT DOCUMENTS

| | | |
|---|---|---|
| JP | 2002373570 | * 12/2002 |
| WO | WO03041039 | * 5/2003 |
| WO | WO2004081965 | * 9/2004 |

* cited by examiner

*Primary Examiner*—Joseph L Williams
*Assistant Examiner*—Fatima N Farokhrooz
(74) *Attorney, Agent, or Firm*—D. Austin Bonderer

(57) ABSTRACT

A field emission device (5) includes cathode electrodes (51), emitters (52) formed on the cathode electrodes, grid electrodes (54) formed over the cathode electrodes at a distance apart from the emitters, and isolated films (55) formed on surfaces of the grid electrodes neighboring the emitters. Preferably, the isolated film has a thickness ranging from 0.1 to 1 microns. The isolated film may be a film made of one or more insulating materials, such as $SiO_2$ and $Si_3N_4$. Alternatively, the one or more insulating materials can be selected from a material having a high secondary electron emission coefficient, such as MgO, $Al_2O_3$ and ZnO. Additionally, the isolated film can be further formed on a second surface of the grid electrode distal from the emitter.

10 Claims, 2 Drawing Sheets

FIELD EMISSION DEVICE WITH INCREASED CURRENT OF EMITTED ELECTRONS

BACKGROUND

1. Field of the Invention

The present invention relates to a field emission device, and more particularly to a field emission device having a grid electrode.

2. Background

Field emission devices are based on emission of electrons in a vacuum, and emit light by electrons emitted from micron-sized tips in a strong electric field, accelerating, and colliding with a fluorescent material. The field emission devices are thin and light with high brightness.

Diode field emission devices having a conventional structure can be easily manufactured. However, they are disadvantageous in controlling emission current and realizing a moving picture or gray-scale picture. Accordingly, instead of a diode structure, a triode structure is commonly required.

Referring to FIG. 4, a typical triode field emission device includes a cathode electrode 40, an anode electrode 45, and a grid electrode 43 located therebetween. A vacuum chamber between the cathode electrode 40 and the anode electrode 45 is maintained by several spacers 44. The cathode electrode 40 has a number of fine emitters 41 formed thereon. Generally, an insulating layer 42 is arranged between the cathode electrode 40 and the grid electrode 43, electrically isolating the cathode electrode 40 and the grid electrode 43. The insulating layer 42 includes a number of tiny through holes corresponding to the emitters 41. The grid electrode 43 is arranged on a top surface of the insulating layer 42, for extracting electrons from the emitters 41.

Nevertheless, during the electron emitting process, it is unavoidable that some of the emitting electrons are captured by the grid electrode 43. In particular, when the grid electrode 43 is provided with a high voltage, the attraction between the grid electrode 43 and the emitting electrons is stronger, and the number of captured electrons increases. As a result, an emitting efficiency of the whole device is reduced, and the energy efficiency of the field emission device is also reduced.

SUMMARY

In one aspect of the present invention, there is provided a field emission device which includes a cathode electrode, an emitter formed on the cathode electrode, a grid electrode formed over the cathode electrode at a distance apart from the emitter, and an isolated film formed on a first surface of the grid electrode neighboring the emitter.

Preferably, the isolated film has a thickness ranging from 0.1 to 1 microns. The isolated film may be a film made of one or more insulating materials, such as $SiO_2$ and $Si_3N_4$. Alternatively, the one or more insulating materials can be selected from a material having a high secondary electron emission coefficient, such as MgO, $Al_2O_3$ and ZnO. Additionally, the isolated film can be further formed on a second surface of the grid electrode distal from the emitter.

A material of the emitter can be selected from carbon nanotubes, diamond, diamond-like carbon (DLC), and silicon, or the emitter can be made of a tip-shaped metal material.

The field emission device may further include an insulating layer between the cathode electrode and the grid electrode. Further, the isolated film extends from the first surface of the grid electrode such that the isolated film is also formed on a surface of the insulating layer neighboring the emitter.

The field emission device may further include an anode electrode formed over the grid electrode and facing the cathode electrode.

In another aspect of the present invention, there is provided a method for making a field emission device having a cathode electrode, an emitter formed thereon, and a grid electrode formed over the cathode electrode at a distance apart from the emitter, which includes the step of: forming an isolated film on a first surface of the grid electrode neighboring the emitter.

Preferably, the forming step is performed by way of evaporation. The evaporation can further include the step of spinning the grid electrode. Preferably, evaporated molecules of the material of the isolated films shoot at a surface of the grid electrode at an oblique angle.

It is preferable that the method further includes the step of: forming a sacrificial layer on a predetermined portion of a second surface of the grid electrode apart from the emitter.

The method preferably further includes the step of: removing the sacrificial layer from the second surface of the grid electrode, whereby the isolated film deposited on the sacrificial layer is removed.

These and other features, aspects and advantages of the invention will become more apparent from the following detailed description and claims, and the accompanying drawings.

DETAILED DESCRIPTION OF THE PREFERRED EMBODIMENTS

Figure 1:
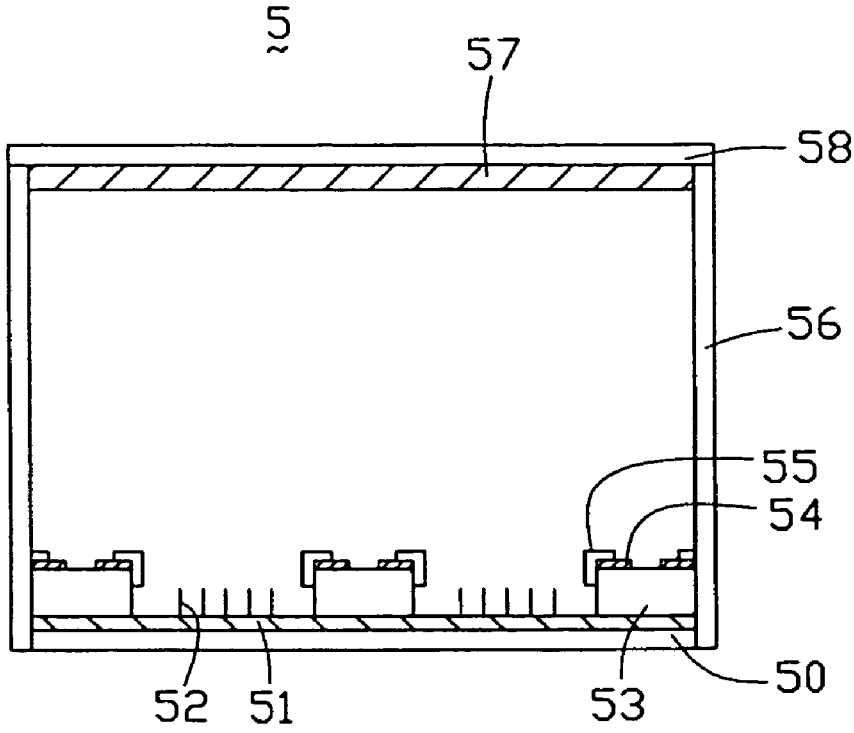
FIG. 1 is a schematic, cross-sectional view of a field emission display in accordance with a first embodiment of the present invention.

With reference to FIG. 1, there is shown a field emission display 5 in accordance with a first embodiment of the present invention. The field emission display 5 comprises a front substrate 58 and a rear substrate 50 facing thereto. The front substrate 58 is separated from the rear substrate 50 by several spacers 56 arranged therebetween. A chamber maintained by the spacers 56 between the front substrate 58 and the rear substrate 50 is preferably a vacuum. A plate-like anode electrode 57 is disposed on a surface of the front substrate 58 facing to the rear substrate 50. Cathode electrodes 51 are disposed in parallel strips on an anode-facing surface of the rear substrate 50. A plurality of electron emitters 52 are formed on predetermined portions of the cathodes 51, and electrically connect therewith. An insulating layer 53 is located on the cathodes 51. The insulating layer 53 defines a plurality of first through holes corresponding to the emitters 52, for exposing the emitters 52 to the anode 57. Grid electrodes 54 are formed in parallel strips on an anode-facing surface of the insulating layer 53, the grid electrodes 54 being arranged crosswise relative to the cathodes 51. Each of the grid electrodes 54 is separated a distance from the emitters 52, and defines a plurality of second through holes corresponding to the emitters 52. Isolated films 55 are formed on parts of surfaces of the grid electrodes neighboring the emitters 52.

It is noted that the isolated films 55 can only cover parts of the emitter-neighboring surfaces of the grid electrodes 54, such as inner walls of the second through holes thereof. If desired, the isolated films 55 can extend to cover parts of surfaces of the insulating layer 53, such as inner walls of the first through holes that face toward the emitters 52.

In operation, a proportion of electrons emitted from the emitters 52 at relative large angles shoot at the grid electrodes 54 due to the attraction thereof. Because of the coating of the isolated films 55 on the grid electrodes 54, most of the electrons cannot directly reach surfaces of the grid electrodes 54, and instead change their emitting angles toward the anode 57 after hitting the isolated films 55. As a result, the number of electrons captured by the grid electrodes 54 is significantly reduced. A more efficient use of the emitting electrons is accordingly obtained.

In the first embodiment, the isolated films 55 are made of one or more insulating materials, such as $SiO_2$ and/or $Si_3N_4$. Alternatively, the insulating materials may be one or more materials having a high secondary electron emission coefficient, such as MgO, $Al_2O_3$, and/or ZnO. Consequently, the isolated films 55 may emit electrons when they are subjected to the collisions by the electrons emitted from the cathodes 51. Therefore, a current of emitting electrons is increased, and the efficiency of the field emission display 5 can be improved. Thicknesses of the isolated films 55 are minimal, so that the isolated films 55 do not materially affect the electrical field between the cathodes 51 and the grid electrodes 54. Preferably, each of the isolated films 55 has a thickness ranging from 0.1 to 1 microns.

A material of the emitters 52 is selected from electrical conductors such as carbon-based materials, and may, for example, be carbon nanotubes, diamond, diamond-like carbon (DLC), or silicon. Alternatively, the emitters 52 can be silicon tips or metal tips.

The anode 57 is a conductive layer formed on the front substrate 58, and is generally made of indium-tin oxide. Fluorescent layers are formed in strips on an emitter-facing surface of the anode 57: The cathodes 51 are made of Ag, Cu, or other conductive metal materials.

In a process for manufacturing the field emission display 5, the cathodes 51 are screen-printed on a glass plate as the rear substrate 50. An insulating material is deposited on the top surface of the cathodes 51, thereby forming the insulating layer 53. The insulating layer 53 is etched to form the first through holes, and parts of surfaces of the cathodes 51 corresponding to the first through holes are exposed. The emitters 52 are patterned on the exposed surfaces of the cathodes 51, and are formed by chemical vapor deposition. Alternatively, films containing a material of the emitters 52 made in advance are arranged on the cathodes 51, forming the emitters 52 by a sol-gel process or by gluing thereon. The grid electrodes 54 are formed in parallel strips on part of a surface of the insulating layer 53 crossing the cathodes 51 by a screen-printed process. The grid electrodes 54 are etched to form the second through holes thereof.

Figure 2A:
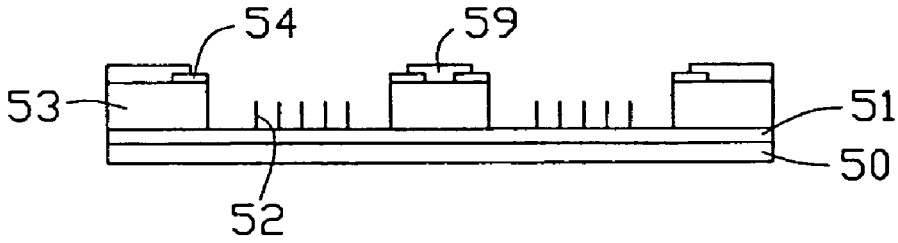
FIGS. 2A-2C are schematic, cross-sectional views of successive stages in a process for manufacturing isolated films of the field emission display shown in FIG. 1.
Figure 2B:
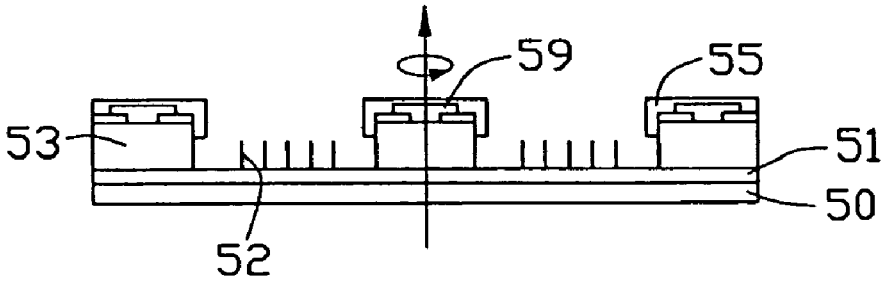
Figure 2C:
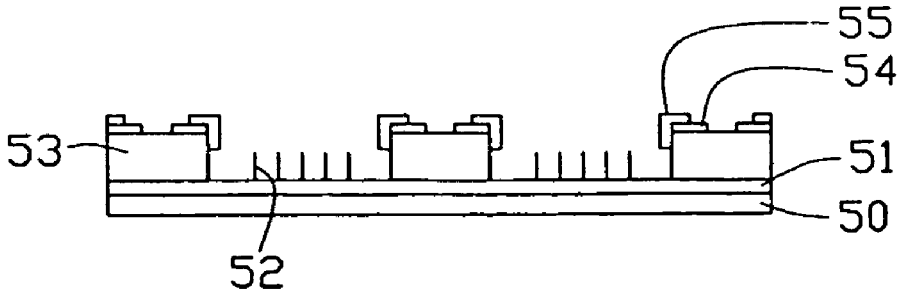

Referring to FIGS. 2A-2C, in the first embodiment, sacrificial layers 59 are formed on predetermined portions of the surfaces of the grid electrodes 54, such as surfaces of the grid electrodes 54 distal from the emitters 52. Materials of the sacrificial layers 59 are selected from one or more of aluminum and aluminum alloys. The material of the isolated films 55 is evaporated on the grid electrodes 54 to form the isolated films 55. Accordingly, the sacrificial layer 59 is covered thereby. After the isolated films 55 have been formed, the sacrificial layer 59 is removed from the insulating layer 53, and the parts of the isolated films 55 covering the sacrificial layer 59 are correspondingly removed thereby. As a result, the isolated layers 55 are arranged on the parts of the surfaces of the grid electrodes 54 neighboring the emitters 52.

Preferably, during the evaporation, the grid electrodes 54 are spun, and evaporated molecules of the material of the isolated films 55 are driven to shoot at the surfaces of the grid electrodes 54 at an oblique angle. The oblique angle is selected according to desired parameters, such as diameters and locations of the first and second through holes, so that the emitters 52 are secured to be exposed to the anode 57.

The anode 57 is formed on a glass plate as the front substrate 58 by depositing indium-tin oxide on the front substrate 58. A fluorescent material is patterned on predetermined regions of the anode 57 facing the emitters 52 to form the fluorescent layer. Spacers 56 are interposed between the rear substrate 50 and the front substrate 58. Air between the rear substrate 50 and the front substrate 58 is drawn out therefrom by a pump to form a substantial vacuum. After some encapsulating procedures, the field emission display 5 is thereby formed.

Alternatively, the anode 57 can be formed in parallel strips, and the cathodes 51 and grid electrodes 54 can be formed like a full surface. The cathodes 51 and grid electrodes 54 can be formed in strips by deposition and photolithography/etching. In addition, molding plates corresponding to the cathodes 51, the insulating layer 53 and the grid electrodes 54 can be made in advance and applied in the field emission display 5 respectively. A manufacturing sequence between the front substrate 58 and the rear substrate 50 can be re-arranged, and should not be construed to be limited by the first embodiment.

It is noted that how to manufacture a part of the field emission display 5, such as the cathodes 51, the insulating layer 53, the grid electrodes 54, or the anode 57, and how to encapsulate a field emission display can be referenced in U.S. Pat. No. 6,380,671 and U.S. Pat. No. 6,515,415.

Figure 3:
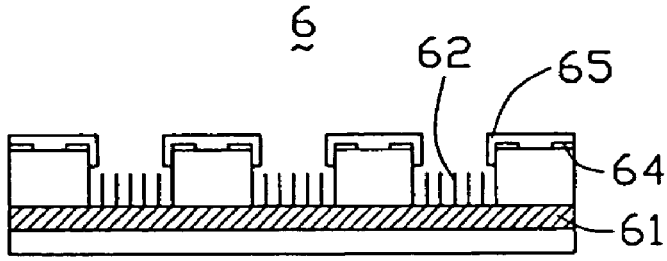
FIG. 3 is a schematic, cross-sectional view of part of a field emission cathode device in accordance with a second embodiment of the present invention.
Figure 4:
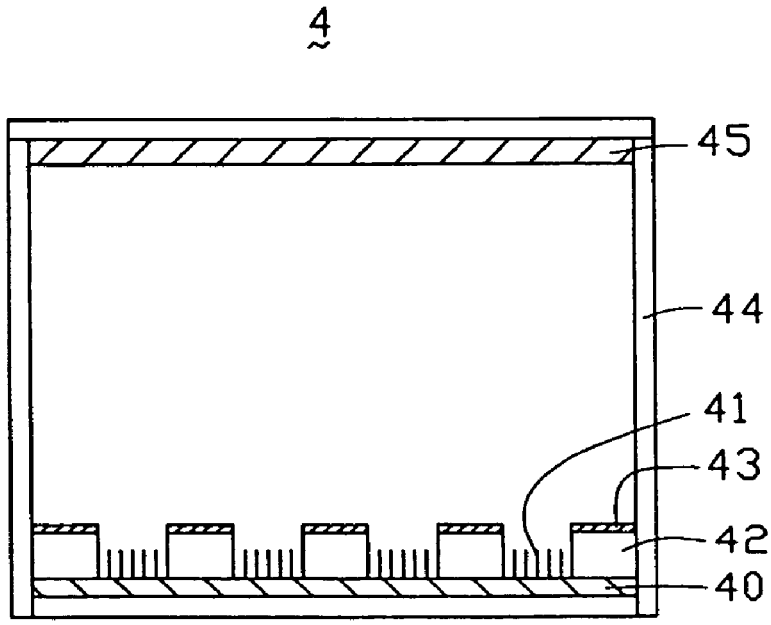
FIG. 4 (PRIOR ART)
FIG. 4 is a schematic, cross-sectional view of a conventional triode field emission device.

With reference to FIG. 3, there is shown a field emission cathode device 6 in accordance with a second embodiment of the present invention. The field emission cathode device 6 includes a cathode 61 having emitters 62 formed thereon and grid electrodes 64 arranged over the cathode 61. The grid electrodes 64 are covered by an isolated film 65. The isolated film 65 includes apertures corresponding to the emitters 62. This differs from the first embodiment in that the isolated film 65 is further formed on a surface of the grid electrodes 64 distal from the emitters 62 besides the emitter-neighboring surface thereof. Accordingly, a method for making the field emission cathode device 6 is similar to the method for making the field emission display 5 described above, with due alteration of details. The main difference between the two methods is that in the second embodiment, the isolated layer 65 is directly formed on the grid electrodes 64 without a sacrificial layer being preformed thereon.

It should be further noted that the field emission cathode device 6 can be coupled to an appropriate anode device in order to provide a combined field emission apparatus; for example, a field emission lamination device, a field emission display, or a field emission scanning microscope.

Finally, while the present invention has been described with reference to particular embodiments, the description is illustrative of the invention and is not to be construed as limiting the invention. Therefore, various modifications can be made to the embodiments by those skilled in the art without departing from the true spirit and scope of the invention as defined by the appended claims.

We claim:

1. A field emission device comprising:

a cathode electrode;

an emitter formed on the cathode electrode for emitting electrons;

an insulating layer located on the cathode electrode;

a grid electrode attached on an anode-facing surface of the insulating layer; and an isolated film attached on only a part of an anode-facing surface of the grid electrode and covering a side of the grid electrode and only a part of a side of the insulating layer;

wherein the part of the anode-facing surface of the grid electrode having the isolated film is adjacent to the emitter, and a part of the anode-facing surface of the grid electrode which is farther away from the emitter is exposed out of the isolated film, the side of the grid electrode covered by the isolated film is in alignment with the side of the insulating layer covered by the isolated film.

2. The field emission device according to claim 1, wherein the isolated film has a thickness ranging from 0.1 microns to 1 micron.

3. The field emission device according to claim 1, wherein the isolated film is made of one or more insulating materials.

4. The field emission device according to claim 1, wherein a material of the emitter is selected from the group consisting of carbon nanotubes, diamond, diamond-like carbon (DLC), and silicon.

5. The field emission device according to claim 1, wherein the emitter is made of a tip-shaped metal material.

6. The field emission device according to claim 1, further comprising an insulating layer between the cathode electrode and the grid electrode.

7. The field emission device according to claim 1, further comprising an anode electrode formed over the grid electrode and facing the cathode electrode.

8. The field emission device according to claim 3, wherein the one or more insulating materials is selected from the group consisting of $SiO_2$ and $Si_3N_4$.

9. The field emission device according to claim 3, wherein the one or more insulating materials comprise one or more materials having a secondary electron emission coefficient equal to or above 3.1.

10. The field emission device according to claim 9, wherein the one or more materials having a high secondary electron emission coefficient are selected from the group consisting of MgO, $Al_2O_3$, and ZnO.

* * * * *